US011200875B2

(12) United States Patent
Ahn

(10) Patent No.: US 11,200,875 B2
(45) Date of Patent: Dec. 14, 2021

(54) METHOD OF SHIELDING ACOUSTIC WAVE

(71) Applicant: University of Seoul Industry Cooperation Foundation, Seoul (KR)

(72) Inventor: Do Yeol Ahn, Seoul (KR)

(73) Assignee: UNIVERSITY OF SEOUL INDUSTRY COOPERATION FOUNDATION, Seoul (KR)

( * ) Notice: Subject to any disclaimer, the term of this patent is extended or adjusted under 35 U.S.C. 154(b) by 544 days.

(21) Appl. No.: 16/240,087

(22) Filed: Jan. 4, 2019

(65) Prior Publication Data

US 2020/0184941 A1 Jun. 11, 2020

(30) Foreign Application Priority Data

Dec. 7, 2018 (KR) ..... 10-2018-0156683

(51) Int. Cl.
*G10K 11/162* (2006.01)

(52) U.S. Cl.
CPC ..... *G10K 11/162* (2013.01)

(58) Field of Classification Search
CPC ..... G10K 11/162; G10K 11/16
USPC ..... 181/284
See application file for complete search history.

(56) References Cited

U.S. PATENT DOCUMENTS 9,390,702 B2 * 7/2016 Mathur ..... G10K 11/162

FOREIGN PATENT DOCUMENTS

KR 1994-0018797 8/1994
KR 10-1796836 12/2017

OTHER PUBLICATIONS

Yong Y. Lee et al.,; "Lossless acoustic half-bipolar cylindrical cloak with negative-index metamaterial"; Japanese Journal of Applied Physics; vol. 57, (2018) pp. 057301-1 to 057301-5.

* cited by examiner

*Primary Examiner* — Forrest M Phillips
(74) *Attorney, Agent, or Firm* — Kile Park Reed & Houtteman PLLC

(57) ABSTRACT

A method of shielding acoustic wave, which is capable of completely shielding sound while reducing consumption of a shielding material is provided. The method of shielding acoustic wave, includes covering an object to be shielded with a first shielding material so that a lower portion of the object to be shielded is opened, covering an upper portion of the first shielding material by using a second shielding material which is an acoustic wave meta material having same absolute value but negative sign in density and bulk modulus comparing to the first shielding material, and covering the second shielding material with a third shielding material.

3 Claims, 10 Drawing Sheets
(7 of 10 Drawing Sheet(s) Filed in Color)

METHOD OF SHIELDING ACOUSTIC WAVE

CROSS REFERENCE TO RELATED APPLICATION

This application claims priority from and the benefit of Korean Patent Applications No. 10-2018-0156683, filed on Dec. 7, 2018, which is hereby incorporated by reference for all purposes as if fully set forth herein.

BACKGROUND OF THE INVENTION

Field of the Invention

The present invention relates to a method of shielding acoustic wave, and more particularly, to a method of shielding acoustic wave by generating a space in which acoustic wave is not present by a medium, thereby completely blocking acoustic wave.

Discussion of the Background

Most people are exposed to various sounds. Among these sounds, there is a sound to be enjoyed like music, while there are sounds to be blocked like various noises.

Particularly, in a submarine, etc., it is very important to block the acoustic waves generated from the submarine because there is a risk of exposure to the enemy by the acoustic waves. Various studies have been conducted for shielding these acoustic waves.

For example, according to a method for attenuating acoustic waves passing from a source to a destination according to Korean Patent Laid-Open Publication No. 10-1994-0018797, woven web with thermoplastic fibers having an average effective fiber diameter of about 15 microns or less, a thickness of about 0.5 cm or more, density of about 50 kg/$m^2$ or less and a pressure drop across web for a water of about 1 mm or more and a flow rate of 32 liters/minute is prepared, and the woven web is installed between the source and the destination to absorb acoustic wave.

In this way, most sound blocking methods can attenuate the sound amplitude and make the sound smaller, but it is impossible to completely block the sound.

In order to solve such a problem, the present inventor filed a Korean patent No. 10-1796836, "Method of shielding acoustic wave". In the method of shielding acoustic wave, after covering the upper and lower portions of the object to be shielded with the shielding material determined according to the characteristics determined according to the density and the bulk modulus of the shielding medium, the pressure and the fluid velocity, a substance with same absolute value but a different sign of density and bulk modulus were charged to shield the shielded object to shield the object.

However, shielding both the upper and lower portions of the object to be shielded requires a large amount of shielding material.

SUMMARY OF THE INVENTION

Accordingly, it is an object of the present invention to provide a method of shielding acoustic wave, which is capable of completely shielding sound while reducing consumption of a shielding material.

The method of shielding acoustic wave, includes covering an object to be shielded with a first shielding material so that a lower portion of the object to be shielded is opened, covering an upper portion of the first shielding material by using a second shielding material which is an acoustic wave meta material having same absolute value but negative sign in density and bulk modulus comparing to the first shielding material, and covering the second shielding material with a third shielding material.

On the other hand, the object to be shielded may be covered with the third shielding material disposed between $\sigma_2<\sigma_1$ of bipolar cylindrical coordinates determined by coordinate axes of ($\sigma$, $\tau$, z).

In this case, a density according to the position of the third shielding material satisfies the relational equation $\rho_o=(\sigma_2-\pi)/(\sigma_2-\sigma_1)$.

According to the method of shielding acoustic wave, it is possible to achieve complete shielding and fundamentally blocking the acoustic wave, instead of attenuating the amplitude of the acoustic wave, while reducing the consumption of the shielding material.

BRIEF DESCRIPTION OF THE DRAWINGS

The patent or application file contains at least one drawing executed in color. Copies of this patent or patent application publication with color drawings will be provided by the Office upon request and payment of the necessary fee.

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
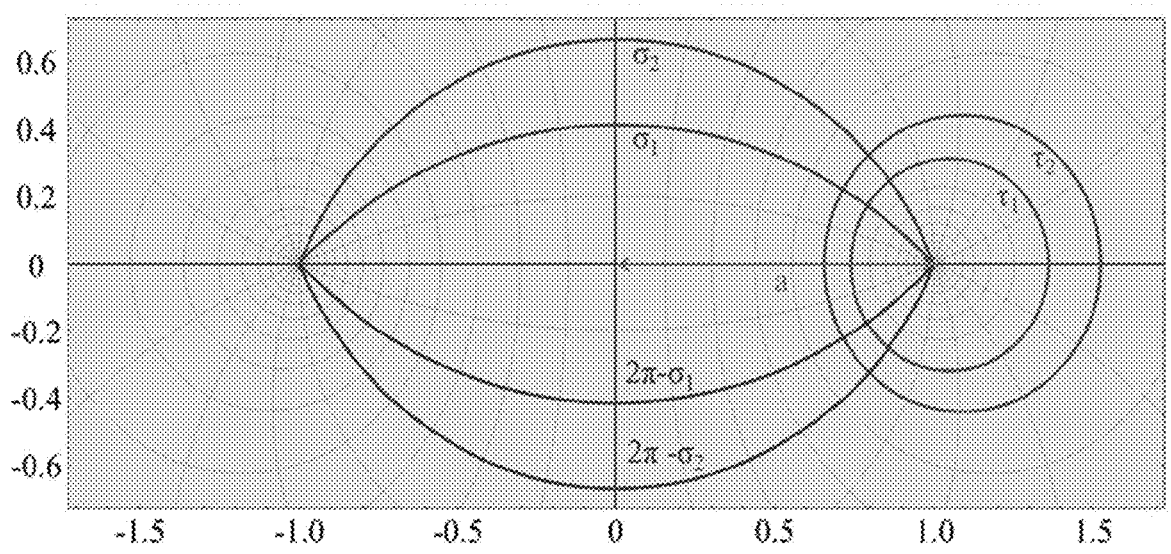
FIG. 1 is a diagram showing the relationship between a bipolar cylindrical coordinates system and a Cartesian coordinate system.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

Hereinafter, exemplary embodiments of the present invention will be described in detail.

The present invention relates to a shielding design technique for acoustic waves having general time dependency. The present inventor has found symmetry between an acoustic wave equation and an electromagnetic wave equation having symmetry in the z-axis. Based on this, conventional shielding for electromagnetic waves is applied to apply shielding against acoustic waves.

Symmetry of Acoustic Wave Equation and Maxwell Equation

The acoustic wave equation is given by the following Equation 1.

$$\rho\frac{\partial\vec{v}}{\partial t} = -\vec{\nabla}p,\qquad \frac{\partial p}{\partial t} = -\lambda\vec{\nabla}\cdot\vec{v} \tag{Equation 1}$$

In Equation 1, 'p' is the pressure wave (acoustic wave), 'v' is the velocity vector of the medium, 'ρ' is the density of the shielding medium, and 'λ' is the bulk modulus of the medium.

There is a lot of research on how to implement a transparent cloak for electromagnetic waves, but the implementation of a transparent cloak for acoustic waves has not been studied much. Here, the inventor found that in the two-dimensional case, the acoustic equation described in Equation 1 and the Maxwell equation of the electromagnetic wave have a one-to-one correspondence with respect to a specific polarization, and a method of shielding electromagnetic wave is applicable to a method of shielding acoustic wave based on this correlation. Therefore, the present inventor provides the method of shielding acoustic wave. The present invention proposes a method of preventing a sound wave from reaching a certain area in space, and is also applicable to noise shielding and the like.

With respect to a generalized curvilinear coordinate, Equation 1 can be expressed as following Equation 2.

$$\vec{\nabla}p = \hat{q}_1\frac{1}{h_1}\frac{\partial p}{\partial q_1} + \hat{q}_2\frac{1}{h_2}\frac{\partial p}{\partial q_2} + \hat{q}_3\frac{1}{h_3}\frac{\partial p}{\partial q_3} \tag{Equation 2}$$

$$\vec{\nabla}\cdot\vec{v} = \frac{1}{h_1h_2h_3}\left[\frac{\partial}{\partial q_1}(v_1h_2h_3) + \frac{\partial}{\partial q_2}(v_2h_3h_1) + \frac{\partial}{\partial q_3}(v_3h_1h_2)\right]$$

In the above Equation 2, a hat of $q_i$ is the unit vector of $q_i$ axis (i—1, 2, 3), and '$h_i$' is a metric for indicating the distance between two points on the $q_i$ axis.

Assuming, for convenience, that there is symmetry about the z-axis in two dimensions, $q_3=z$, $h_3=1$, and $\partial/\partial z=0$.

In particular, when the acoustic equation is time-harmonic, it can be expressed as the following Equation 3.

$$\rho_1\frac{\partial v_1}{\partial t} = -\frac{1}{h_1}\frac{\partial p}{\partial q_1}, \tag{Equation 3}$$

-continued $$\rho_2\frac{\partial v_2}{\partial t} = -\frac{1}{h_2}\frac{\partial p}{\partial q_2},$$

$$\frac{1}{\lambda}\frac{\partial p}{\partial t} = -\frac{1}{h_1h_2}\left[\frac{\partial}{\partial q_1}(v_1h_2) + \frac{\partial}{\partial q_2}(v_2h_1)\right].$$

On the other hand, the Maxwell equation for the electromagnetic field is expressed by following Equation 4.

$$\vec{\nabla}\times\vec{E} = -\frac{\partial\vec{B}}{\partial t},\ \vec{\nabla}\times\vec{H} = \frac{\partial\vec{D}}{\partial t},\ \nabla\cdot\vec{D} = 0,\ \vec{\nabla}\cdot\vec{B} = 0 \tag{Equation 4}$$

In addition, a rotational operation of a general vector field F is expressed by the following Equation 5.

$$\vec{\nabla}\times\vec{F} = \hat{q}_1\frac{1}{h_2h_3}\left\{\frac{\partial}{\partial q_2}(h_3F_3) - \frac{\partial}{\partial q_3}(h_2F_2)\right\} + \hat{q}_2\frac{1}{h_3h_1}\left\{\frac{\partial}{\partial q_3}(h_1F_1) - \frac{\partial}{\partial q_1}(h_3F_3)\right\} + \hat{q}_3\frac{1}{h_1h_2}\left\{\frac{\partial}{\partial q_1}(h_2F_2) - \frac{\partial}{\partial q_3}(h_1F_1)\right\}, \tag{Equation 5}$$

Therefore, the Maxwell's equation, which is invariant with respect to the z-axis, is expressed by following Equation 6 and Equation 7.

$$\begin{aligned}\vec{\nabla}\times\vec{H} &= \hat{q}_1\frac{1}{h_2}\frac{\partial}{\partial q_2}H_z - \hat{q}_2\frac{1}{h_1}\frac{\partial}{\partial q_1}H_z + \hat{z}\frac{1}{h_1h_2}\left\{\frac{\partial}{\partial q_1}(h_2H_2) - \frac{\partial}{\partial q_2}(h_1H_1)\right\}\\ &= \frac{\partial}{\partial t}\vec{D}\\ &= \hat{q}_1\varepsilon_1\frac{\partial}{\partial t}E_1 + \hat{q}_2\varepsilon_2\frac{\partial}{\partial t}E_2 + \hat{q}_3\varepsilon_3\frac{\partial}{\partial t}E_3,\end{aligned} \tag{Equation 6}$$

$$\begin{aligned}\vec{\nabla}\times\vec{E} &= \hat{q}_1\frac{1}{h_2}\frac{\partial}{\partial q_2}E_z - \hat{q}_2\frac{1}{h_1}\frac{\partial}{\partial q_1}E_z + \hat{z}\frac{1}{h_1h_2}\left\{\frac{\partial}{\partial q_1}(h_2E_2) - \frac{\partial}{\partial q_2}(h_1E_1)\right\}\\ &= -\frac{\partial}{\partial t}\vec{B}\\ &= -\hat{q}_1\mu_1\frac{\partial}{\partial t}H_1 - \hat{q}_2\mu_2\frac{\partial}{\partial t}H_2 - \hat{q}_3\mu_3\frac{\partial}{\partial t}H_3.\end{aligned} \tag{Equation 7}$$

Equation 8 can be obtained from Equation 6 and Equation 7 with respect to the TM waves ($E_1$, $E_2$, and $H_z$).

$$\varepsilon_1\frac{\partial}{\partial t}E_1 = \frac{1}{h_2}\frac{\partial}{\partial q_2}H_z,\qquad \varepsilon_2\frac{\partial}{\partial t}E_2 = -\frac{1}{h_1}\frac{\partial}{\partial q_1}H_z,\qquad -\mu_z\frac{\partial}{\partial t}H_z = \frac{1}{h_1h_2}\left\{\frac{\partial}{\partial q_1}(h_2E_2) - \frac{\partial}{\partial q_2}(h_1E_1)\right\}. \tag{Equation 8}$$

By comparing Equations 3 and 8, it is possible to find symmetry such as Equation 9 for acoustic waves and electromagnetic waves.

$$[p, v_1, v_2, \rho_1, \rho_2, \lambda^{-1}] \leftrightarrow [H_z, E_2 - E_1, \varepsilon_2, \varepsilon_1, \mu_z]. \tag{Equation 9}$$

By using the symmetry derived from Equation 9, it is possible to obtain a shield against acoustic waves from a formula that induces shielding for electromagnetic waves.

Equivalence of an Inhomogeneous Effective Bi-Anisotropic Medium and a Vacuum Space for Electromagnetic Waves To determine the effect of gravity or warped space time on the general physics system, all Lorentz tensors described by special relativity equations in Minkowski space is replaced by moving objects like tensors under general coordinate transformation [R M Wald, General Relativity (University of Chicago Press, Chicago, 1984, J. Schwinger, Phys. Rev. 130, 800 (1963)]. And also substitutes the Minkowski metric tensor $\eta_{ab}$ is substituted by the metric tensor $g_{\mu\nu}$. Here, the Minkowski metric tensor $\eta_{ab}$ is expressed by the following Equation 10.

$$\eta_{\infty}=-1,\eta_{11}=\eta_{22}=\eta_{33}=1 \quad \text{Equation 10}$$

The equation is then generally covariant. The general covariance Maxwell's equation is expressed by the following Equation 11.

$$F^{\mu\nu}_{;\mu} = \frac{1}{\sqrt{-g}}\frac{\partial}{\partial x^{\mu}}\left(\sqrt{-g}\,F^{\mu\nu}\right) = -J \quad \text{Equation 11}$$

In Equation 11, 'g' is a determinant of the metric tensor $g_{\mu\nu}$.

Further, the covariance tensor $F_{\mu\nu}$ of the contravariant tensor $F^{\mu\nu}$ satisfies the following Equation 12.

$$F_{\mu\nu;\lambda}+F_{\lambda\mu;\nu}+F_{\nu\lambda;\mu}=0 \quad \text{Equation 12}$$

On the other hand, in Equation 12, the electromagnetic field tensor $F_{\mu\nu}$ is expressed by the following Equation 13.

$$F_{\mu\nu} = \begin{pmatrix} 0 & -E_x & -E_y & -E_z \\ E_x & 0 & B_z & -B_y \\ E_y & -B_z & 0 & B_x \\ E_z & B_y & -B_x & 0 \end{pmatrix} \quad \text{Equation 13}$$

In addition, a new contraveriant tensor $H^{\mu\nu}$ is defined as the following Equation 14.

$$H^{\mu\nu}=\varepsilon_0\sqrt{-g}g^{\mu\lambda}g^{\nu\rho}F_{\lambda\rho} \quad \text{Equation 14}$$

In this equation, the contraveriant tensor $H^{\mu\nu}$ can be expressed by the following Equation 15.

$$H^{\mu\nu} = \begin{pmatrix} 0 & D_x & D_y & D_z \\ -D_x & 0 & H_z & -H_y \\ -D_y & -H_z & 0 & H_x \\ -D_z & H_y & -H_x & 0 \end{pmatrix} \quad \text{Equation 15}$$

The following Equations 16 and 17 can be obtained from the equations from the above Equation 11 to Equation 15.

$$D_i = -\frac{\varepsilon_0\sqrt{-g}}{g_{00}}g^{ij}E_j + \frac{1}{g_{00}}[ijk]g_{j0}H_k \quad \text{Equation 16}$$

$$H_i = -\frac{\varepsilon_0\sqrt{-g}}{g_{00}}g^{ij}H_j - \frac{1}{g_{00}}[ijk]g_{j0}E_k \quad \text{Equation 17}$$

In Equation 16 and Equation 17, [ijk] is an anti-symmetric permutation symbol with [xyz]=1. That is, when ijk is exchanged evenly in [ijk], it gives a value of 1, and when it is exchanges odd times, it gives a value of −1.

On the other hand, the following Equations 18 and 19 can be obtained from Equations 16 and 17.

$$\vec{D} = \varepsilon_0\overset{\leftrightarrow}{\varepsilon}\cdot\vec{E} + \vec{w}\times\vec{H} \quad \text{Equation 18}$$

$$\vec{B} = \frac{\overset{\leftrightarrow}{\mu}\cdot\vec{H}}{\varepsilon_0} - \vec{w}\times\vec{E} \quad \text{Equation 19}$$

In the Equations 18 and 19, the symmetric tensors of ε and μ and the vector of w are given by the following Equations 20 and 21, respectively.

$$\varepsilon = \mu = -\frac{\varepsilon_0\sqrt{-g}}{g_{00}}g^{ij} \quad \text{Equation 20}$$

$$w_i = \frac{g_{0i}}{g_{00}} \quad \text{Equation 21}$$

From this, the warped space-time of a vacuum can be seen as an effective anisotropic medium, where the electric permittivity tensor and the magnetic permeability tensor can be described as space-time metrics.

Conversely, a dielectric medium can be described by curved space or coordinate system by a coordinate transformation.

On the other hand, the contravarient metric tensor is transformed as shown in the following Equation 22, and the covariance matrix tensor is transformed as shown in the following Equation 23.

$$g^{\alpha\beta} = \frac{\partial x^{\alpha}}{\partial x'^{\mu}}\frac{\partial x^{\beta}}{\partial x'^{\nu}}e'^{\mu\nu} \quad \text{Equation 22}$$

$$g_{\alpha\beta} = \frac{\partial x'^{\mu}}{\partial x^{\alpha}}\frac{\partial x'^{\nu}}{\partial x^{\beta}}g_{\mu\nu} \quad \text{Equation 23}$$

Suppose that the physical medium is described by a spatial coordinate system $x_i$ having a spatial metric $\gamma_{ij}$ and a determinant γ. The spatial metric $\gamma_{ij}$ should be different from the space portion of the effective spatial metric $g_{\alpha\beta}$ generated by the physical medium, since, $\gamma_{ij}$ describes the actual space-time coordinate system but the spatial metric $g_{\alpha\beta}$ describes the effective geometry corresponding to the original bi-anisotropic medium rather than describing the actual space-time.

Considering the spatial covariance form of divergence in the Maxwell equation, the contitutive parameters are described by the following Equations 24 and 25.

$$\varepsilon = \mu = \mp\frac{\varepsilon_0\sqrt{-g}}{g_{00}\sqrt{\gamma}}g^{ij} \quad \text{Equation 24}$$

$$w_i = \frac{g_{0i}}{\sqrt{\gamma}\,g_{00}} \quad \text{Equation 25}$$

Design of Shielding and Cloaking Devices

Suppose that the space converted from the initial vacuum space-time does not cover the entire physical space for the entire medium, and that the medium excludes the electromagnetic field in a specific area but is smoothly fitted outside the device. Thus, the electromagnetic radiation is guided avoiding the excluded area. As a result, the medium cloaks the region so that no object in the region appears outside. The cloaking device should include anisotropic media. This is because the problem of reverse scattering of waves in isotropic media has a single solution. The realization of the cloaking device or radiation shielding adopts the coordinate transformation of the excluded area.

In the following description, a bipolar cylindrical cloak of a bipolar cylindrical coordinate is designed by using the equivalence of an inhomogeneous effective bi-anisotropic medium and space time of vacuum for the above-mentioned electromagnetic wave.

Suppose that the right-handed coordinate system (x, y, z) of the Cartesian coordinate system and the curvilinear coordinate ($x^1$, $y^1$, $z^1$) are in the relationship shown in the following Equation 26.

$$x=x(x^1,x^2,x^3),$$

$$y=y(x^1,x^2,x^3),$$

$$z=z(x^1,x^2,x^3) \qquad \text{Equation 26}$$

Then, the metric is given by the following Equation 27.

$$ds^2 = dx^2 + dy^2 + dz^2 = \sum_{i,j} \gamma_{ij} dx^i dx^j \qquad \text{Equation 27}$$

On the other hand, an object we want to shield occupies a space within the range represented by the following Equation 28 of the curvilinear coordinate ($x^1$, $y^1$, $z^1$).

$$O<x^1<U_1,$$

$$O<x^2<V_1,$$

$$O<x^3<W_1 \qquad \text{Equation 28}$$

In order to shield the material expressed by the above Equation 28, a meta material is attached so as to have the following range of Equation 29.

$$U_1<x^1<U_2,$$

$$V_1<x^2<V_2,$$

$$W_1<x^3<W_2 \qquad \text{Equation 29}$$

A coordinate system to which the prime is attached is used for space-time coordinate in vacuum space, and physical system is defined by the following Equation 30.

$$x^1 = U_1 + \frac{U_2 - U_1}{U_2} x'^1, \qquad \text{Equation 30}$$

$$x^2 = V_1 + \frac{V_2 - V_1}{V_2} x'^2,$$

$$x^3 = W_1 + \frac{W_2 - W_1}{W_2} x'^3$$

Then, the effective geometry corresponding to the first bi-anisotropic medium is defined by the following Equations 31 and 32.

$$g^{ij} = \frac{\partial x^i}{\partial x'^k} \frac{\partial x^j}{\partial x'^l} \gamma'^{kl} \qquad \text{Equation 31}$$

$$\sqrt{-g} = \sqrt{-g'} \frac{\partial(x'^1, x'^2, x'^3)}{\partial(x^1, x^2, x^3)} = \sqrt{-\gamma'} \frac{\partial(x'^1, x'^2, x'^3)}{\partial(x^1, x^2, x^3)} \qquad \text{Equation 32}$$

In the above equation (32), $\gamma$=Det ($\gamma_{ij}$) and $\gamma^{kk}=1/\gamma_{kk}$.

On the other hand, a conversion formula for calculating the dielectric constant tensor and the permeability tensor can be obtained from the above Equation 26. Considering the form of covariant forms of divergences in the Maxwell equations, the following equations can be obtained.

$$\varepsilon^{ij} = \pm \frac{(-g)^{\frac{1}{2}}}{\sqrt{\gamma}} (g^{0j}, g^{i0} - g^{00} g^{ij}) \qquad \text{Equation 33}$$

$$\alpha^{ij} = \pm \frac{(-g)^{\frac{1}{2}}}{\sqrt{\gamma}} [jkl] g^{0k} g^{il}$$

$$\beta_{lJ} = \frac{\sqrt{\gamma}}{\sqrt{-g}} [jkl] g_{0k} g_{il} \qquad \text{Equation 34}$$

$$(-\mu^{-1})_{ij} = \pm \frac{\sqrt{\gamma}}{\sqrt{-g}} (g_{i0} g_{j0} - g_{00} g_{ij})$$

In the above equations, [ijk] is an anti-symmetric permutation symbol with [xyz]=1. That is, when ijk is exchanged evenly in [ijk], it gives a value of 1, and when it exchanges odd times, it gives a value of −1.

Using the relational expression $g_{\mu\lambda} g^{\lambda\nu} = \delta_\mu{}^\nu$, the above dielectric constant tensor and permeability tensor can be briefly expressed by the following Equation 35.

$$\varepsilon^{ij} = \mu^{ij} = \mp \frac{\sqrt{-g}}{g_{00}\sqrt{\gamma}} g^{ij} \qquad \text{Equation 35}$$

The negative sign in the above equation indicates that the medium has a negative refractive index.

The bipolar cylindrical coordinates shown in FIG. 1 have axes of ($\sigma$, $\tau$, z; a), which is in relationship with a Cartesian coordinate system (x, y, z) as the following Equation 36.

$$\begin{cases} x = a \dfrac{\sinh\tau}{\cosh\tau - \cos\sigma} \\ y = a \dfrac{\sin\sigma}{\cosh\tau - \cos\sigma} \\ z = z \end{cases} . \qquad \text{Equation 36}$$

In Equation 36, each coordinate of $\sigma$, $\tau$, z has the range $0 \le \sigma < 2\pi$, $-\infty < \tau < \infty$, $-\infty < z < \infty$, and a (>0) is an half of distance between the two poles of bipolar coordinate system.

Then, the metric is expressed by the following Equation 37.

$$\gamma_{ij} = \begin{pmatrix} \frac{a^2}{(\cos\sigma - \cosh\tau)^2} & 0 & 0 \\ 0 & \frac{a^2}{(\cos\sigma - \cosh\tau)^2} & 0 \\ 0 & 0 & 1 \end{pmatrix} \quad \text{Equation 37}$$

Referring to FIG. 1, the object to be shielded is disposed in a range of $\sigma 1<\sigma<2\pi-\sigma 1$ and a meta material having a negative refractive index is disposed in a range of $\{\sigma 2\leq\sigma\leq\sigma 1\}\cup\{2\pi-\sigma 1\leq\sigma\leq 2\pi-\sigma 2\}$ to shield the object as shown in FIG. 1. As a result, the map is defined by the following Equation 38.

$$\begin{aligned} \sigma &= \frac{\sigma_2-\sigma_1}{\sigma_2-\pi}(\sigma'-\pi)+\sigma_1,\ \sigma' \in [\sigma_2, \pi] \\ \sigma &= \frac{\sigma_2-\sigma_1}{\sigma_2-\pi}(\sigma'-\pi)+2\pi-\sigma_1,\ \sigma' \in (\pi, 2\pi-\sigma_2] \\ \tau &= \tau' \\ z &= z' \end{aligned} \quad \text{Equation 38}$$

In the above Equation 38, the coordinate system to which the prime is attached is a coordinate system in vacuum, and the coordinate system to which the prime is not attached represents the actual physical system.

From the above Equation 38, the following Equation 39 can be obtained.

$$\begin{aligned} g^{ij} &= \frac{\partial x^i}{\partial x'^k}\frac{\partial x^j}{\partial x'^l}\gamma'^{kl} \\ &= diag\left(\frac{(\sigma_2-\sigma_1)^2}{(\sigma_2-\pi)^2}\frac{1}{a^2}(\cos\sigma'-\cosh\tau)^2,\ \frac{1}{a^2}(\cos\sigma'-\cosh\tau')^2, 1\right) \end{aligned} \quad \text{Equation 39}$$

Then, $\varepsilon^{ij}=\mu^{ij}$, and these values are expressed by the following Equation 40.

$$\varepsilon^{ij} = \frac{\sqrt{-g}}{\sqrt{\gamma}}g^{ij} = \frac{1}{a^2}(\cos\sigma-\cosh\tau)^2 \times diag\left(\frac{\sigma_2-\sigma_1}{\sigma_2-\pi}, \frac{\sigma_2-\pi}{\sigma_2-\sigma_1}, \frac{\sigma_2-\pi}{\sigma_2-\sigma_1}\frac{1}{(\cos\sigma'-\cosh\tau')^2}\right) \quad \text{Equation 40}$$

From the Equation 40, a mixed tensor can be expressed by the following Equation 41.

$$\varepsilon^i_j = \varepsilon^{ik}\gamma_{kj} = diag\left(\frac{\sigma_2-\sigma_1}{\sigma_2-\pi}, \frac{\sigma_2-\pi}{\sigma_2-\sigma_1}, \frac{\sigma_2-\pi}{\sigma_2-\sigma_1}\frac{1}{(\cos\sigma'-\cosh\tau')^2}\right) \quad \text{Equation 41}$$

The following Equations 42 and 43 can be obtained from the above Equations 41 and 9.

$$\rho_\sigma = \varepsilon^\tau_\tau = \frac{\sigma_2-\pi}{\sigma_2-\sigma_1}, \quad \text{Equation 42}$$

-continued $$\begin{aligned} \rho_\tau &= \varepsilon^\sigma_\sigma = \frac{\sigma_2-\sigma_1}{\sigma_2-\sigma_1}, \\ \frac{1}{\lambda} &= \frac{\sigma_2-\pi}{\sigma_2-\sigma_1}\frac{(\cos\sigma-\cosh\tau)^2}{(\cos\sigma'-\cosh\tau')^2}, \\ p &= H_z,\ v_\sigma = E_\tau,\ v_\tau = -E_\sigma. \end{aligned} \quad \text{Equation 43}$$

From the above Equations 42 and 43, when the size of the object to be shielded is determined, the density and bulk modulus can be obtained.

Hereinafter, using the above calculations, a method of shielding acoustic wave according to an exemplary embodiment of the present invention, includes covering an object to be shielded with a first shielding material so that a lower portion of the object to be shielded is opened (see a first region A in FIG. 7), covering an upper portion of the first shielding material by using a second shielding material which is an acoustic wave meta material having same absolute value but negative sign in density and bulk modulus comparing to the first shielding material (see a second region B in FIG. 7), and covering the second shielding material with a third shielding material (see a third region C in FIG. 7).

On the other hand, the object to be shielded may be covered with the third shielding material disposed between $\sigma_2<\sigma_1$ of bipolar cylindrical coordinates determined by coordinate axes of ($\sigma$, $\tau$, z).

In this case, a density according to the position of the third shielding material satisfies the relational equation $\rho_\sigma=(\sigma_2-\pi)/(\sigma_2-\sigma_1)$ as shown in Equation 42.

Hereinafter, comparative examples and embodiments of the present invention will be described.

Comparative Example 1

Figure 2A:
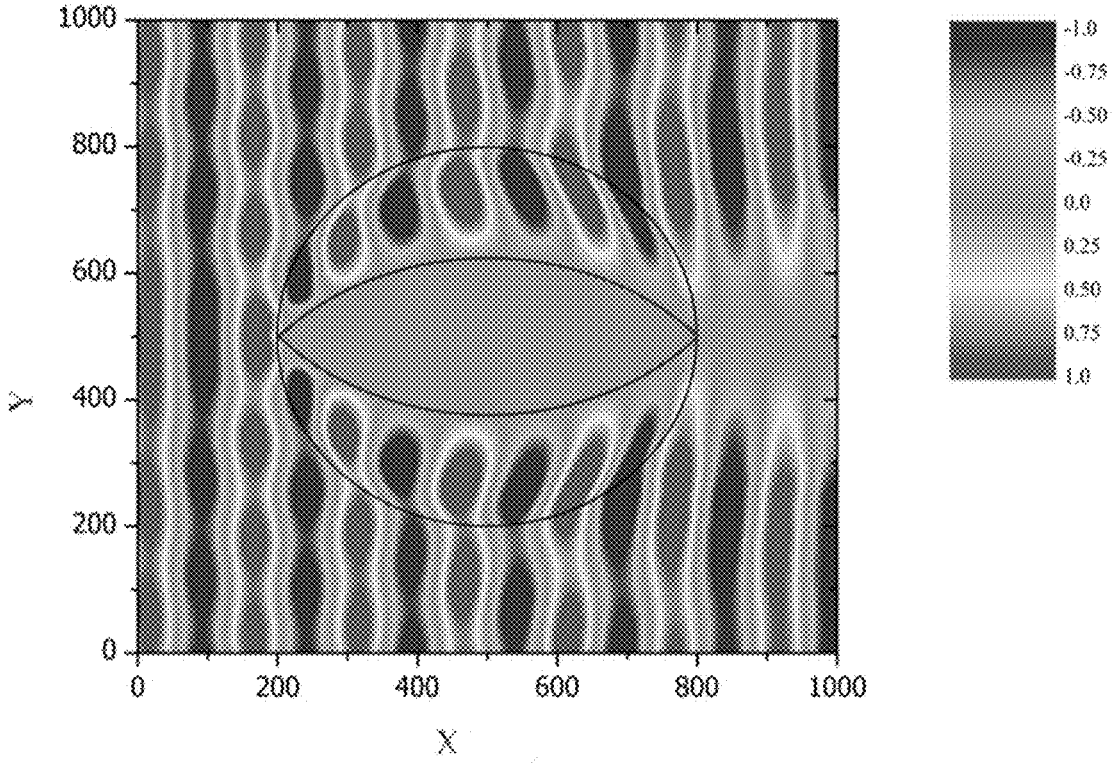
FIGS. 2A and 2B are simulation results showing the case where acoustic waves are incident in the x-axis direction and in the y-axis direction in the first comparative example, respectively.
Figure 2B:
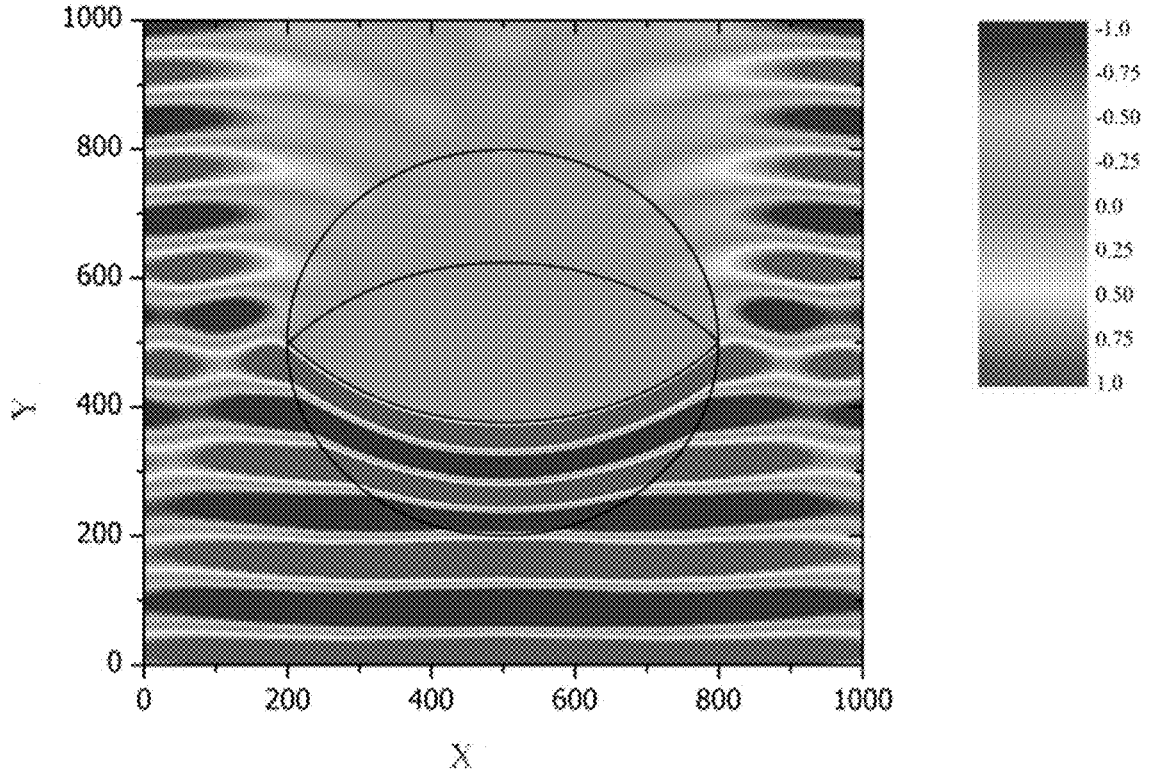

FIGS. 2A and 2B are simulation results showing the case where acoustic waves are incident in the x-axis direction and in the y-axis direction in the first comparative example, respectively.

In the comparative example 1, a shielding material satisfying Equation 42 is filled in the area of $\{\sigma_2\leq\sigma\leq\sigma_1\}\cup\{2\pi-\sigma_1\leq\sigma\leq 2\pi-\sigma_2\}$ of the bipolar cylindrical coordinate system of FIG. 1.

It can be seen from the results of FIGS. 2A and 2B that the acoustic wave cannot reach at least the inside of the bipolar cylindrical cloak, and this result shows that the acoustic wave can be originally blocked in a desired region as well as the isolation of the noise source. This result can be applied to shield the noise the apartment and to shield the ship or submarine.

However, it can be seen from the results of FIGS. 2A and 2B that the shielding method is not perfect. In order to compensate for this, Comparative Example 2 shown below is presented.

Comparative Example 2

Figure 3:
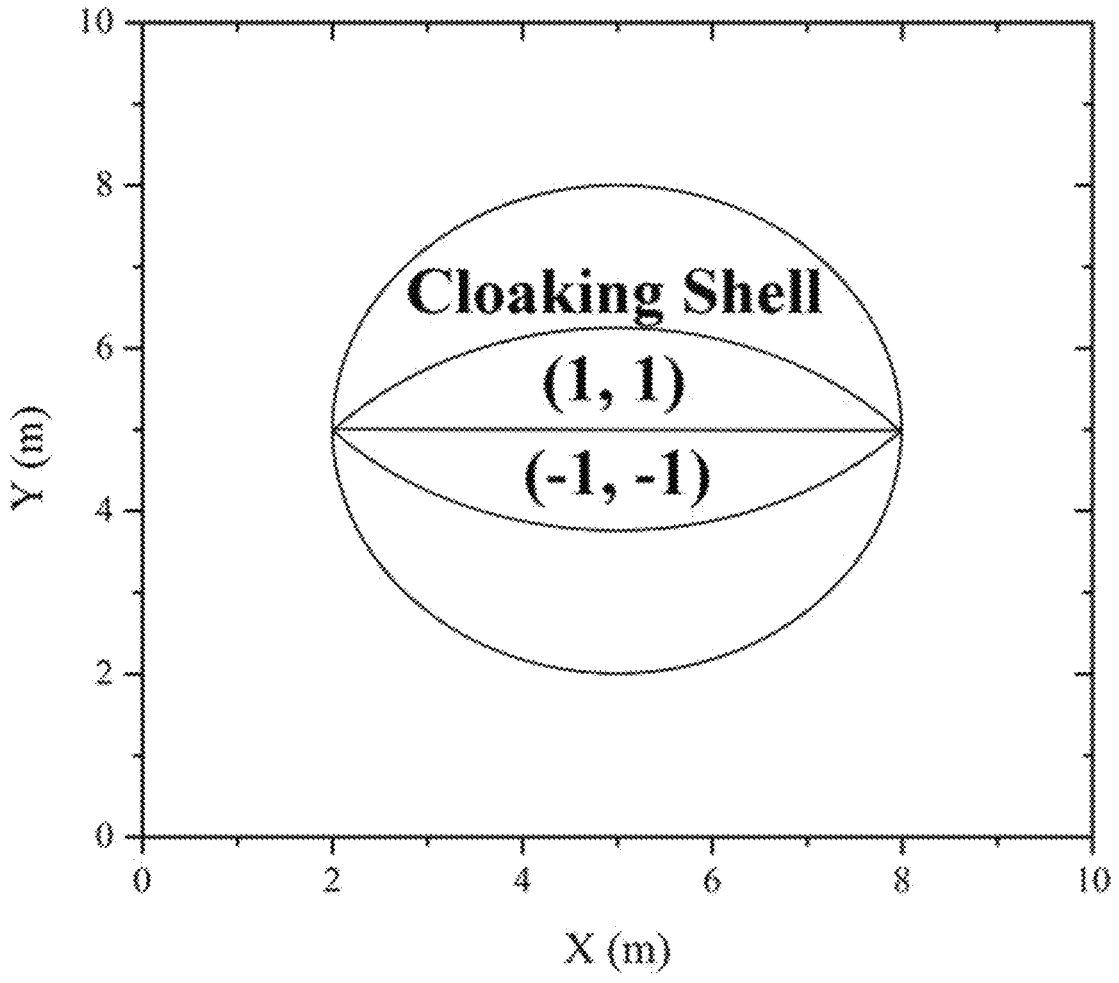
FIG. 3 is a diagram schematically showing a second comparative example.

FIG. 3 is a diagram schematically showing a second comparative example.

In the acoustic wave shielding method according to the second comparative example, one side of the X axis, that is, the upper side in FIG. 3, is covered by acoustic wave meta material with a positive $\rho$ and $\lambda$, and the other side of the X axis, that is, the lower side in FIG. 3, is covered by acoustic wave metal material with a negative $\rho$ and $\lambda$ but same absolute value in addition to the first comparative example described above. For example, simulations were performed with ρ and λ values of 1 at the one side and ρ and λ values of −1 at the other side.

Figure 4A:
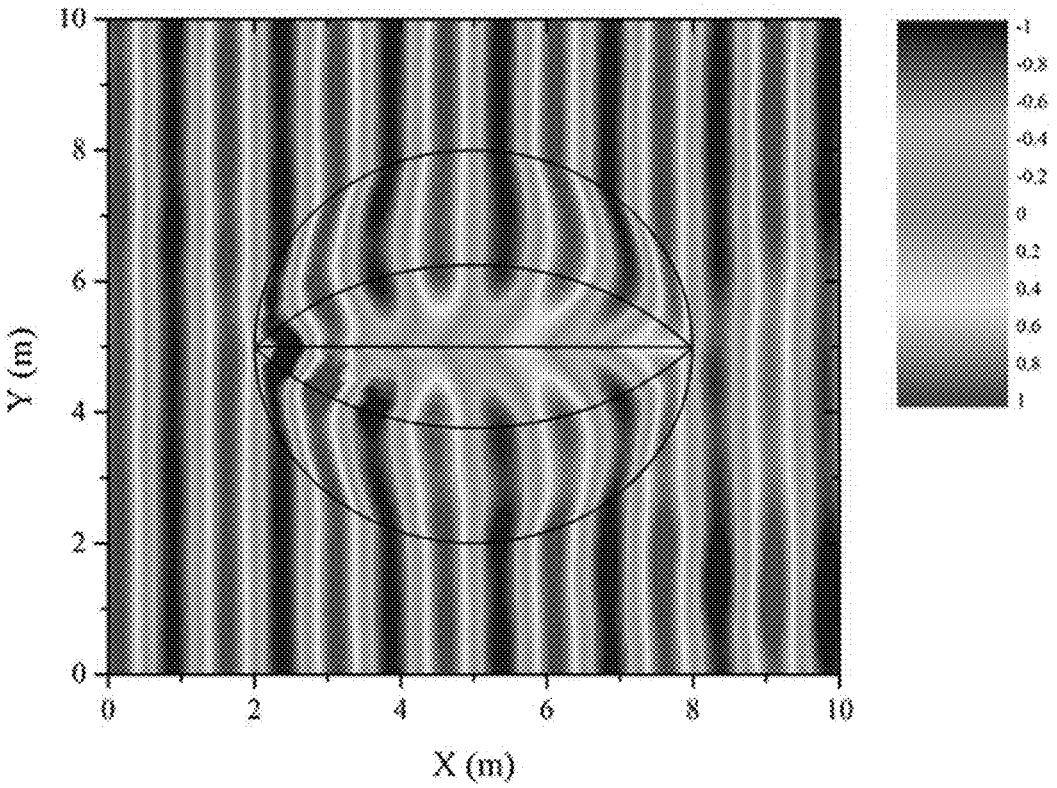
FIGS. 4A and 4B are simulation results showing the case where acoustic waves are incident in the x-axis direction and in the y-axis direction in the second comparative example of FIG. 3, respectively.
Figure 4B:
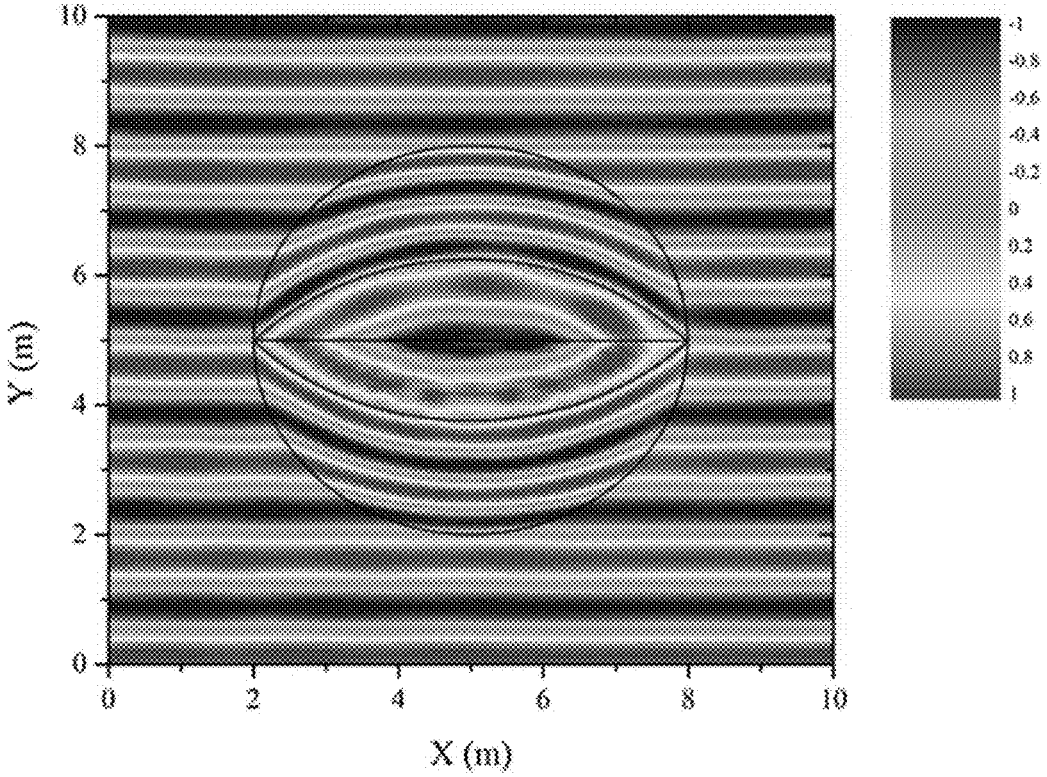

In this case, complete shielding can be achieved as shown in FIGS. 4A and 4B.

Materials with such negative ρ and λ values have been studied experimentally in (1) J. Li and C. T. Chen, Phys. Rev. E70, 055602 (2004). (2) L. Feng, X-P. Liu, Y. B. Chen, Z.-P. Hunang, Y.-W. Mao, Y.-F. Chen, J. Zi, and Y.-Y, Zhu, Phys, Rev. B72, 033108 (2005). (3) S. H. Lee, C. M. Park, Y. M. Seo, Z. G. Wang, and C. K. Kim, Phys. Rev. Lett. 104, 054301 (2010), and the like.

FIGS. 4A and 4B are simulation results showing the case where acoustic waves are incident in the x-axis direction and in the y-axis direction in the second comparative example of FIG. 3, respectively.

Figure 5:
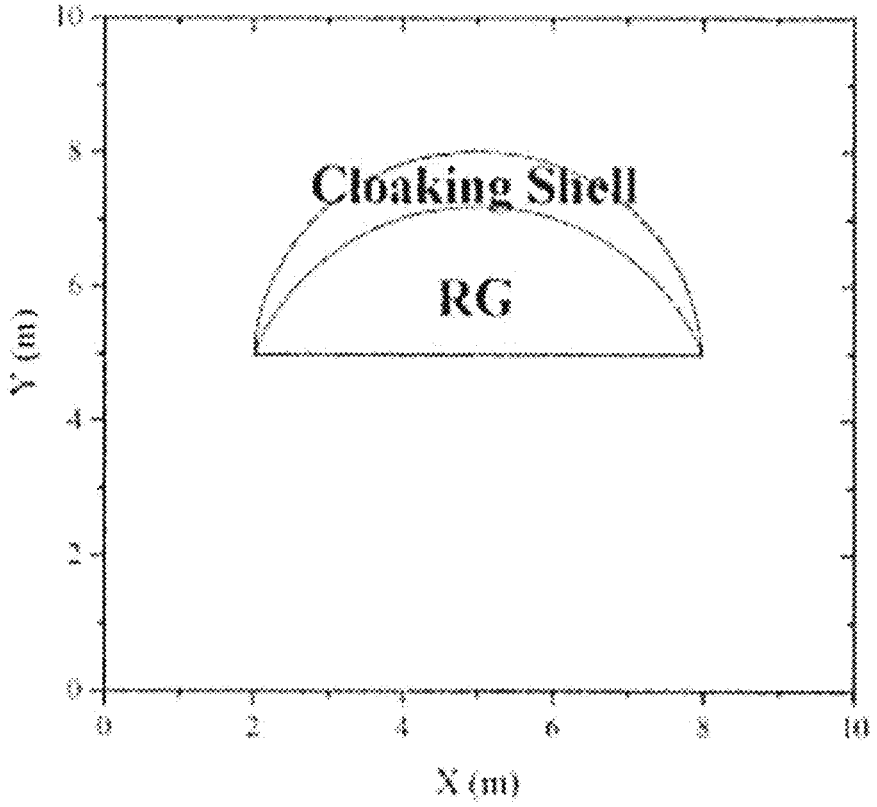
FIG. 5 is a diagram schematically showing a third comparative example.

As shown in FIGS. 4 and 5, when the one side is covered by a material with positive ρ and λ and the other side is covered by a material with negative ρ and λ but same absolute value as shown in FIG. 3, it can be seen that perfect acoustic wave shielding is achieved.

According to the acoustic wave shielding method of comparative example 2, unlike the conventional acoustic wave shielding method, it is possible to achieve complete shielding by fundamentally blocking acoustic waves, instead of attenuating the amplitude of the acoustic waves.

Comparative Example 3

FIG. 5 is a diagram schematically showing a third comparative example.

Figure 6A:
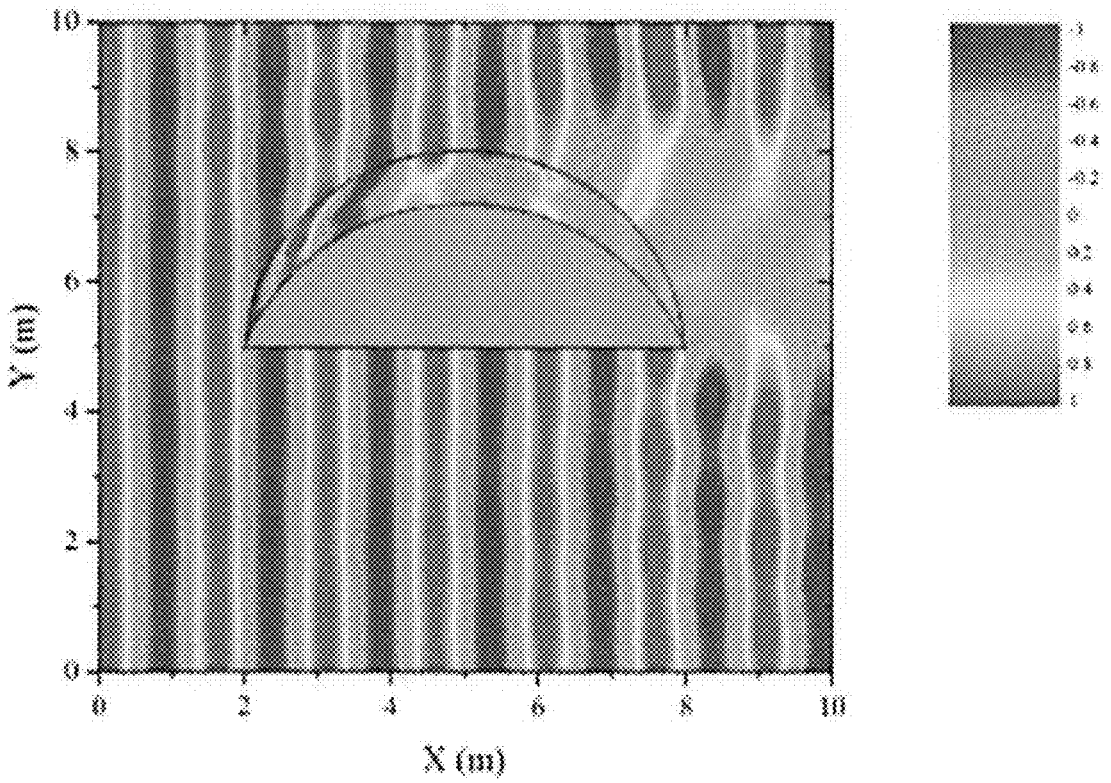
FIGS. 6A, 6B, and 6C are simulation results showing the case where acoustic waves are incident in the x-axis direction, in the negative y-axis direction and in the positive y-direction in the second comparative example of FIG. 5, respectively.
Figure 6B:
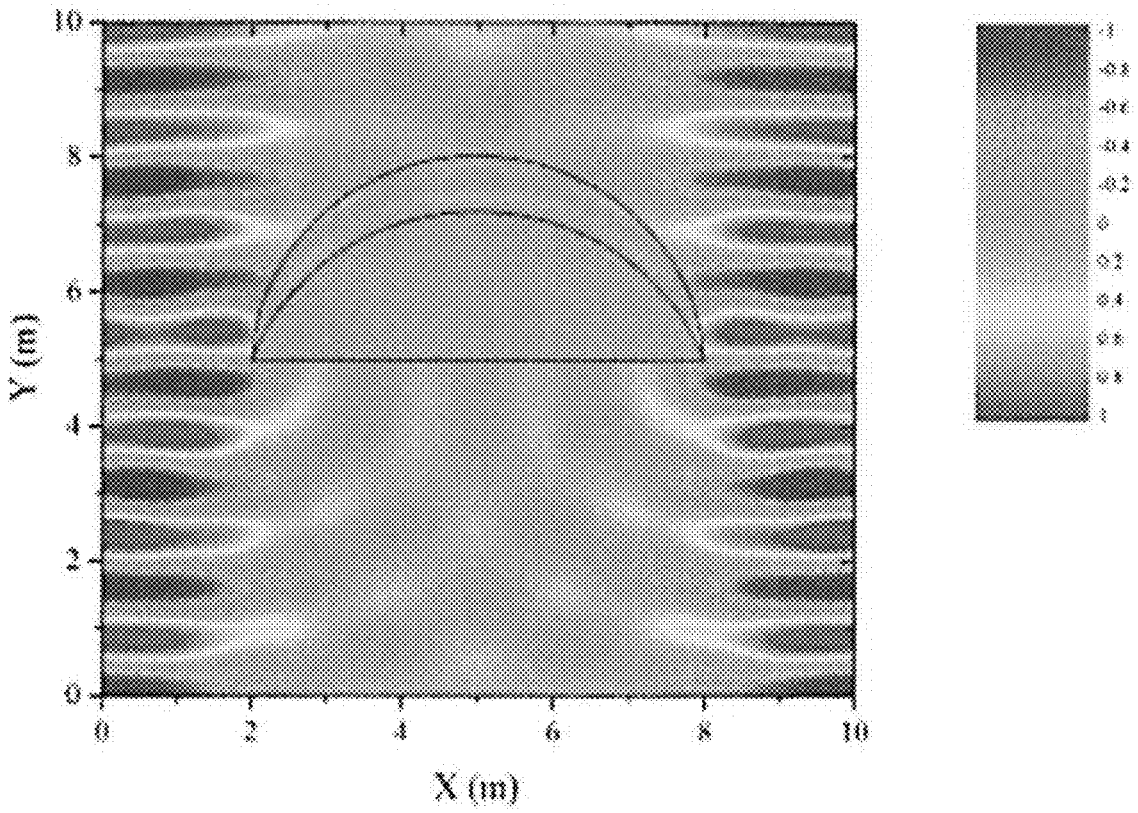
Figure 6C:
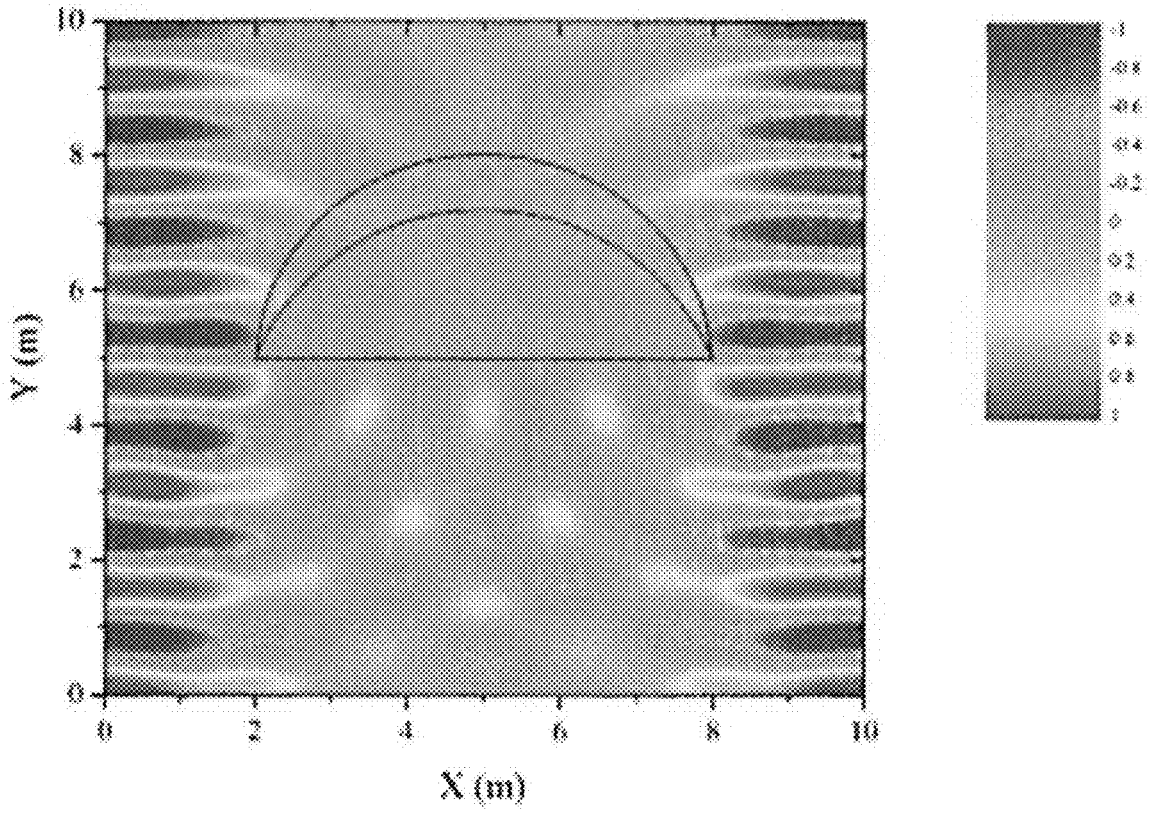

FIGS. 6A, 6B, and 6C are simulation results showing the case where acoustic waves are incident in the x-axis direction, in the negative y-axis direction and in the positive y-direction in the second comparative example of FIG. 5, respectively.

As shown in FIGS. 6A, 6B, and 6C, it can be seen that complete shielding is not achieved when only the upper portion of the object to be shielded is covered.

An Exemplary Embodiment of the Present Invention

Figure 7:
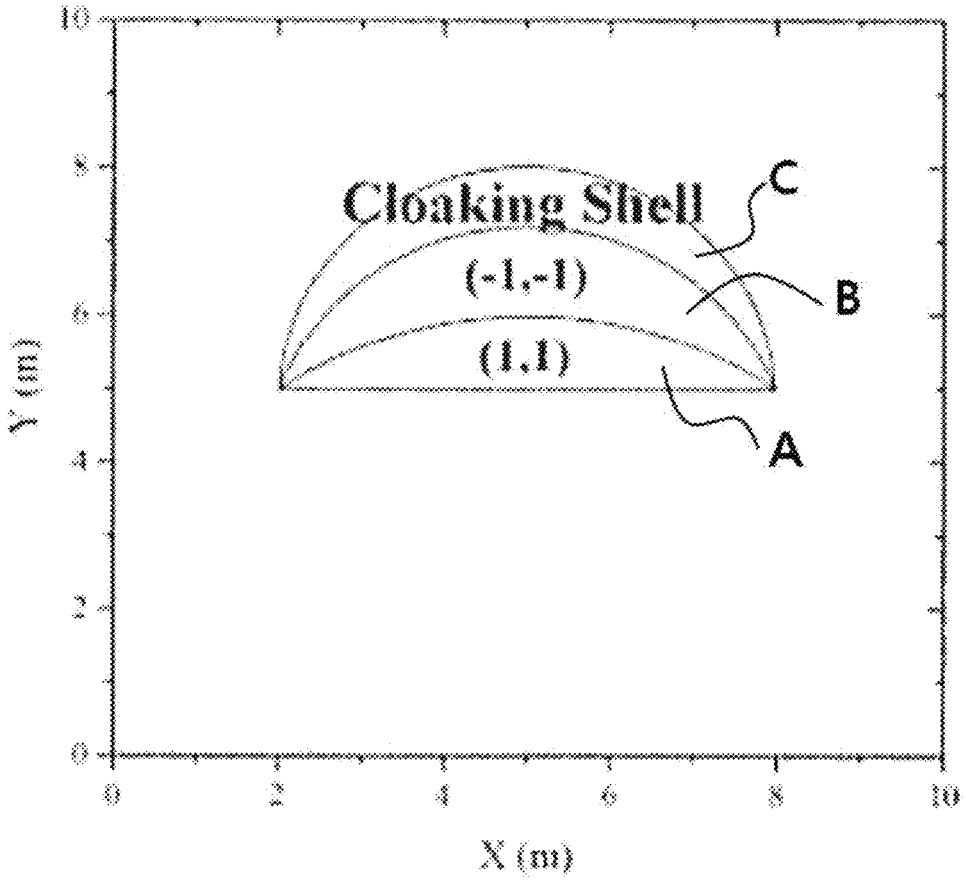
FIG. 7 is a diagram schematically showing an exemplary embodiment of the present invention.

FIG. 7 is a diagram schematically showing an exemplary embodiment of the present invention.

As shown in FIG. 7, a first region A is covered by a material with positive ρ and λ, a second region B above the first region A is covered by an acoustic wave meta material with negative ρ and λ but same absolute value, and a third region C above the second region B is covered by a material satisfying Equation 42.

Figure 8A:
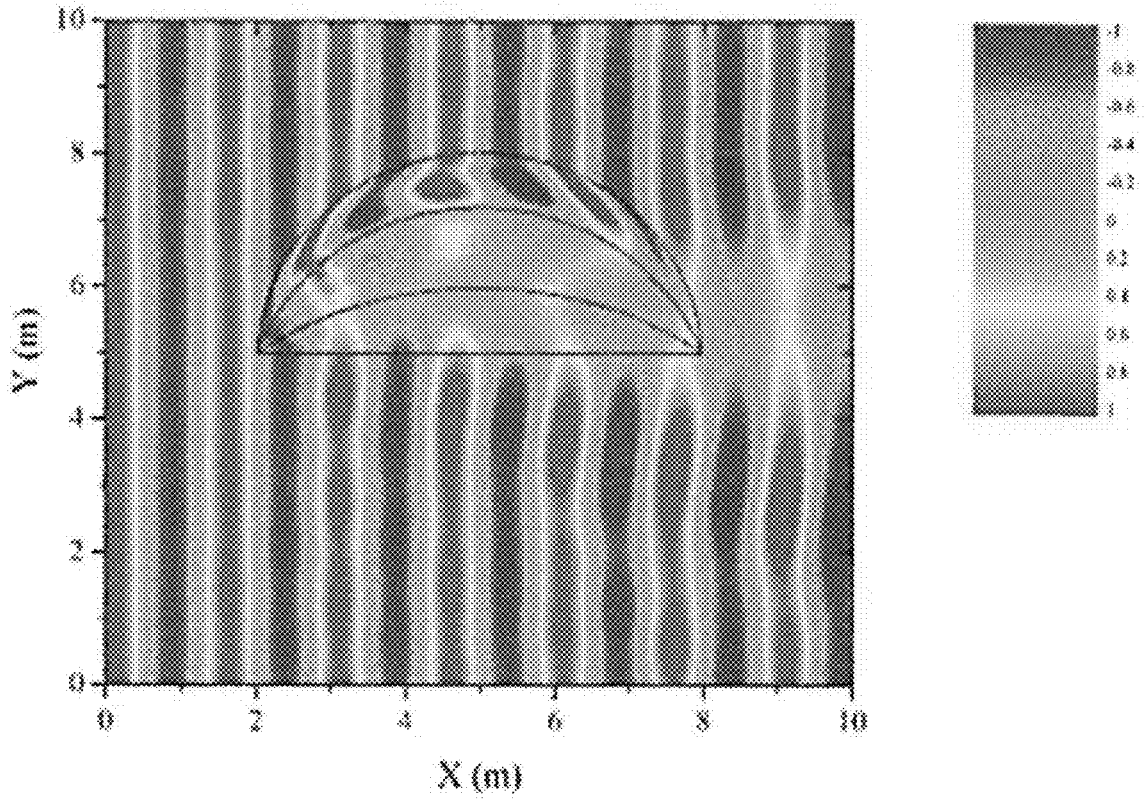
FIGS. 8A, 8B, and 8C are simulation results showing the case where acoustic waves are incident in the x-axis direction, in the negative y-axis direction and in the positive y-direction in the exemplary embodiment of FIG. 7, respectively.
Figure 8B:
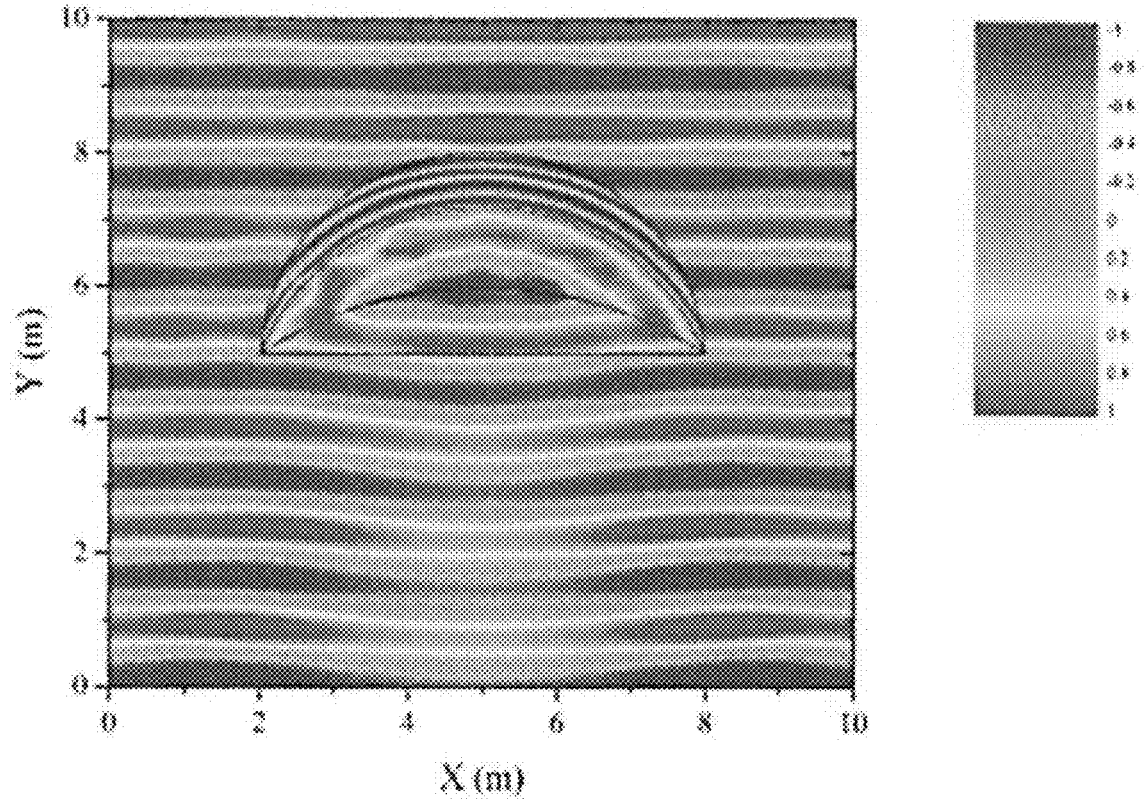
Figure 8C:
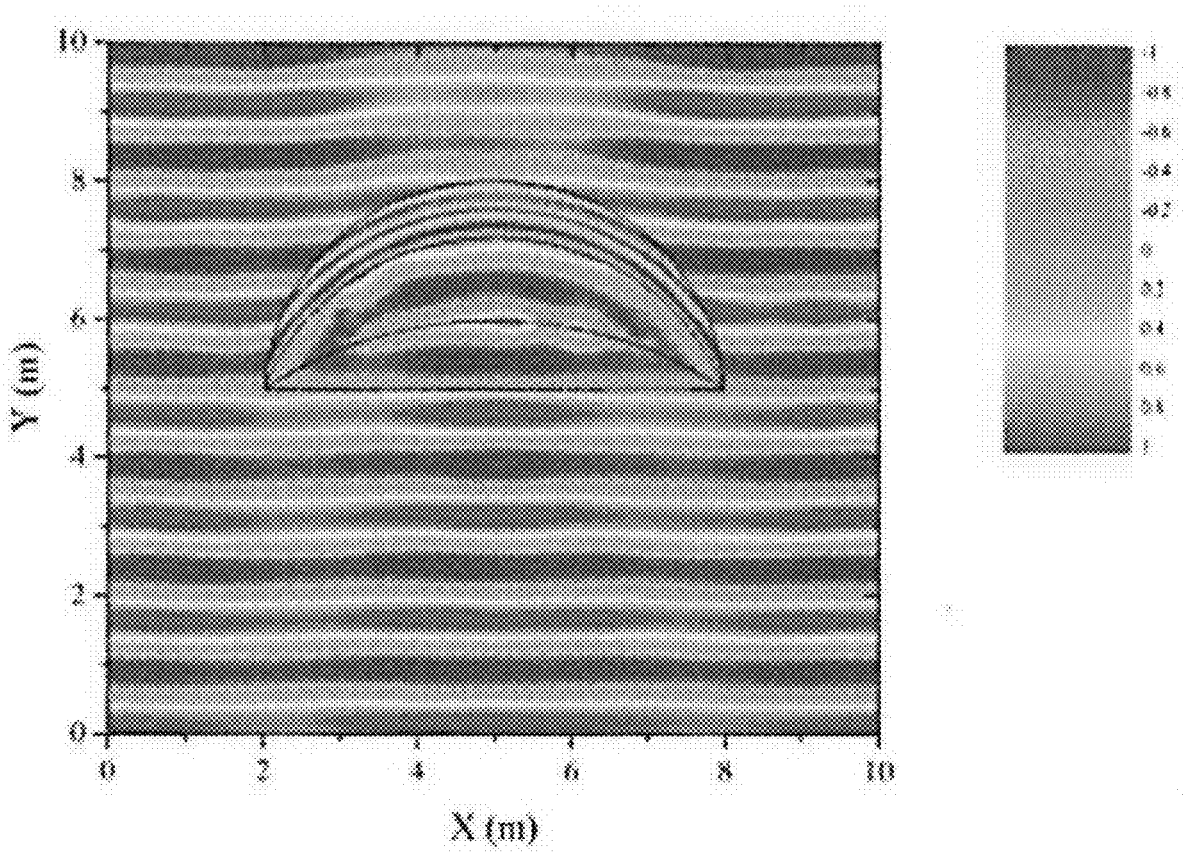

FIGS. 8A, 8B, and 8C are simulation results showing the case where acoustic waves are incident in the x-axis direction, in the negative y-axis direction and in the positive y-direction in the exemplary embodiment of FIG. 7, respectively.

In FIGS. 8A, 8B and 8C, the shielding performance is improved as compared to FIGS. 6A, 6B and 6C.

On the other hand, as a result of the simulation, it seems that the widths of the A and B regions are not significantly influenced. Therefore, in the case where the width of the A region and the B region is reduced and the object to be shielded is arranged in the A region, it is possible to shield the acoustic waves, and it can be seen that shielding is achieved even when covering only the upper portion or the lower portion as compared with Comparative Example 2.

It will be apparent to those skilled in the art that various modifications and variation may be made in the present invention without departing from the spirit or scope of the invention. Thus, it is intended that the present invention cover the modifications and variations of this invention provided they come within the scope of the appended claims and their equivalents.

What is claimed is:

1. A method of shielding acoustic wave, comprising:

covering an object to be shielded with a first shielding material so that a lower portion of the object to be shielded is opened;

covering an upper portion of the first shielding material by using a second shielding material which is an acoustic wave meta material having same absolute value but negative sign in density and bulk modulus comparing to the first shielding material; and covering the second shielding material with a third shielding material.

2. The method of claim 1, wherein the object to be shielded is covered with the third shielding material disposed between $\sigma_2<\sigma_1$ of bipolar cylindrical coordinates determined by coordinate axes of (σ, τ, z).

3. The method of claim 2, wherein a density according to the position of the third shielding material satisfies the relational equation $\rho_\sigma=(\sigma_2-\pi)/(\sigma_2-\sigma_1)$.

* * * * *